US008371314B1

(12) United States Patent
Herd

(10) Patent No.: US 8,371,314 B1
(45) Date of Patent: Feb. 12, 2013

(54) COSMETIC SUPPLY ORGANIZER ASSEMBLY

(76) Inventor: Claudia A. Herd, Kissimmee, FL (US)

( * ) Notice: Subject to any disclaimer, the term of this patent is extended or adjusted under 35 U.S.C. 154(b) by 211 days.

(21) Appl. No.: 12/807,467

(22) Filed: Sep. 7, 2010

(51) Int. Cl.
*A45D 40/24* (2006.01)
*A45D 40/00* (2006.01)

(52) U.S. Cl. ..... 132/314; 132/286

(58) Field of Classification Search ..... 132/286, 132/289, 290, 314, 73; 220/23.4, 23.2, 628, 220/650; 108/54.1, 96, 97, 147.19; 248/311.2; 211/10, 126.1, 126.16
See application file for complete search history.

(56) References Cited

U.S. PATENT DOCUMENTS 2,599,020 A * 6/1952 Safstrom ..... 108/147.19
2,741,048 A * 4/1956 Shelton ..... 206/1.7
2,807,387 A 9/1957 Siciliano
4,003,611 A 1/1977 Smith
4,118,084 A 10/1978 Sussman
D289,105 S 4/1987 Sussman
5,097,963 A * 3/1992 Chernosky et al. ..... 211/60.1
6,032,965 A 3/2000 Sabounjian
2005/0194338 A1 9/2005 Firth

* cited by examiner

*Primary Examiner* — Rachel Steitz

(57) ABSTRACT

A cosmetic supply organizer assembly is provided for organizing and securely holding frequently used cosmetic supplies in a compact space to enhance efficiency. The assembly includes a base tray, an upper tray positionable on the base tray, and a first bowl. The first bowl has a first bowl handle portion. The upper tray has a first upper tray aperture that includes a first upper tray aperture slot portion. Thus, the first upper tray aperture is shaped to receive the first bowl with the first bowl handle portion positioned in the first upper tray aperture slot portion to securely hold the first bowl during use.

15 Claims, 4 Drawing Sheets

COSMETIC SUPPLY ORGANIZER ASSEMBLY

BACKGROUND OF THE DISCLOSURE

Field of the Disclosure

The disclosure relates to cosmetic organizers and more particularly pertains to a new cosmetic organizer for organizing frequently used cosmetic supplies into a compact space to enhance efficiency.

SUMMARY OF THE DISCLOSURE

An embodiment of the disclosure meets the needs presented above by generally comprising a base tray, an upper tray positionable on the base tray, and a first bowl. The first bowl has a first bowl handle portion. The upper tray has a first upper tray aperture that includes a first upper tray aperture slot portion. Thus, the first upper tray aperture is shaped to receive the first bowl with the first bowl handle portion positioned in the first upper tray aperture slot portion to securely hold the first bowl during use.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
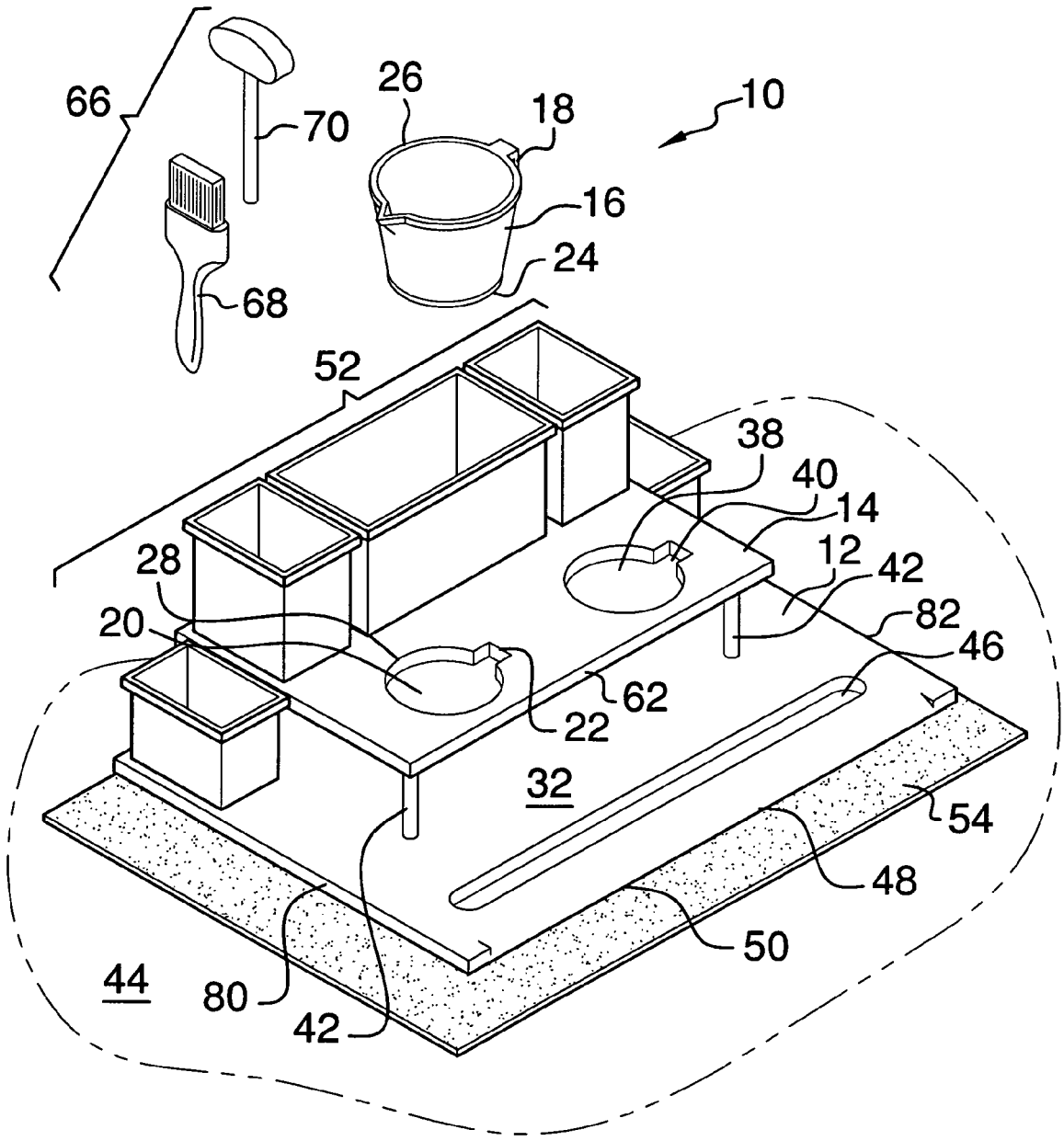
FIG. 1 is a top front side perspective view of a cosmetic supply organizer assembly according to an embodiment of the disclosure.
Figure 2:
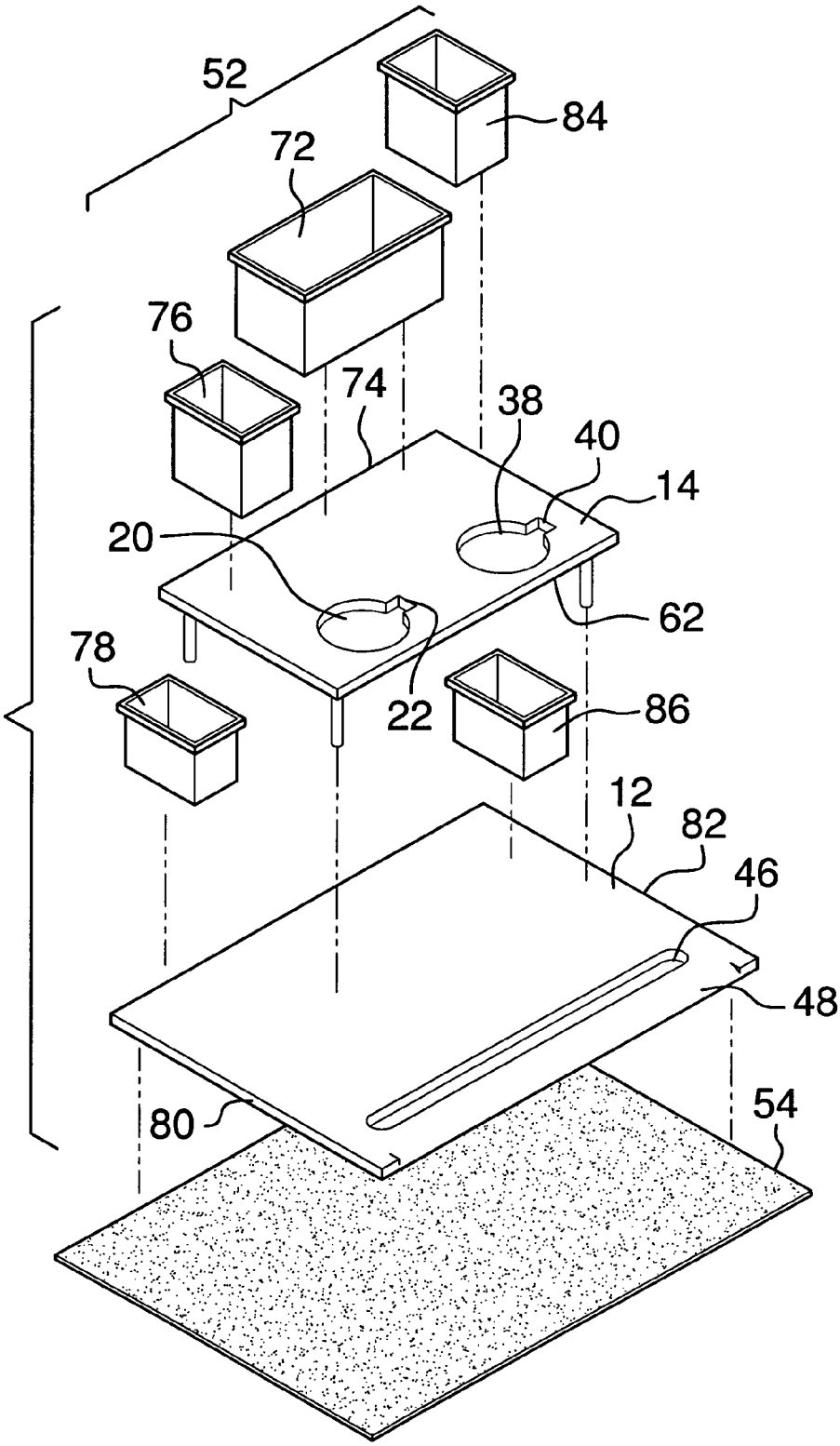
FIG. 2 is a an exploded top front side perspective view of an embodiment of the disclosure.
Figure 3:
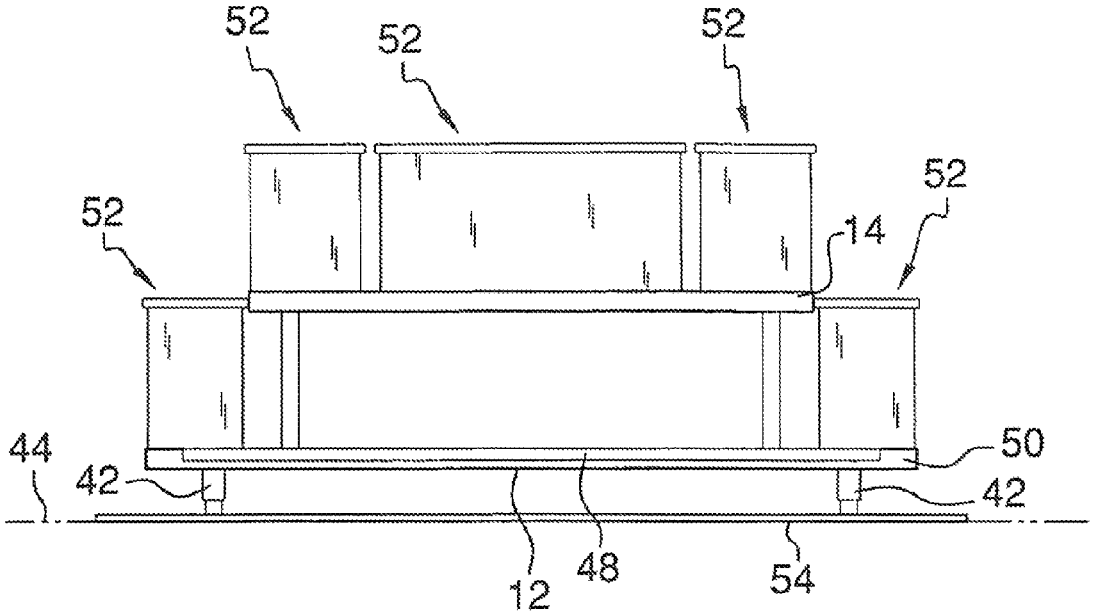
FIG. 3 is a front view of an embodiment of the disclosure.

With reference now to the drawings, and in particular to FIGS. 1 through 5 thereof, a new cosmetic organizer embodying the principles and concepts of an embodiment of the disclosure and generally designated by the reference numeral 10 will be described.

As best illustrated in FIGS. 1 through 5, the cosmetic supply organizer assembly 10 generally comprises a base tray 12, an upper tray 14 positionable on the base tray 12, and a first bowl 16 having a first bowl handle portion 18. The upper tray 14 has a first upper tray aperture 20. The first upper tray aperture 20 includes a first upper tray aperture slot portion 22 such that the first upper tray aperture 20 is shaped to receive the first bowl 16 with the first bowl handle portion 18 positioned in the first upper tray aperture slot portion 22. The first bowl 16 also includes a first bowl bottom portion 24 and a first bowl lip portion 26. A bottom surface 30 of the first bowl lip portion 26 contacts and is supported by a rim 28 of the first upper tray aperture 20 when the first bowl 16 is fully inserted into the first upper tray aperture 20. When fully inserted into the upper tray first aperture 20 the first bowl bottom portion 24 is positioned in spaced relationship to a top surface 32 of the base tray 12.

A second bowl 34 is provided having a second bowl handle portion 36. The upper tray 14 includes a second upper tray aperture 38 having a second upper tray aperture slot portion 40. The second upper tray aperture 38 is similarly shaped to receive the second bowl 34 with the second bowl handle portion 36 positioned in the second upper tray aperture slot portion 40. The second bowl 34 is similarly structured to include a second bowl lip portion 87 and a second bowl bottom portion 88 that is held in position in the same manner as the first bowl 16.

A plurality of base tray legs 42 is provided. The base tray legs 42 are coupled to the base tray 12. The base tray legs 42 are extendable in a conventionally known fashion such that the base tray 12 is positionable a selectable distance above a support surface 44.

Figure 4:
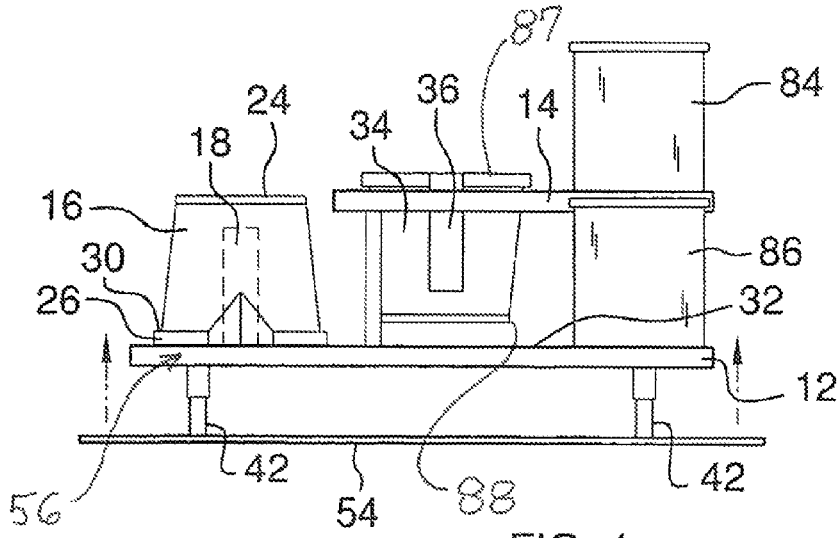
FIG. 4 is a side view of an embodiment of the disclosure.
Figure 5:
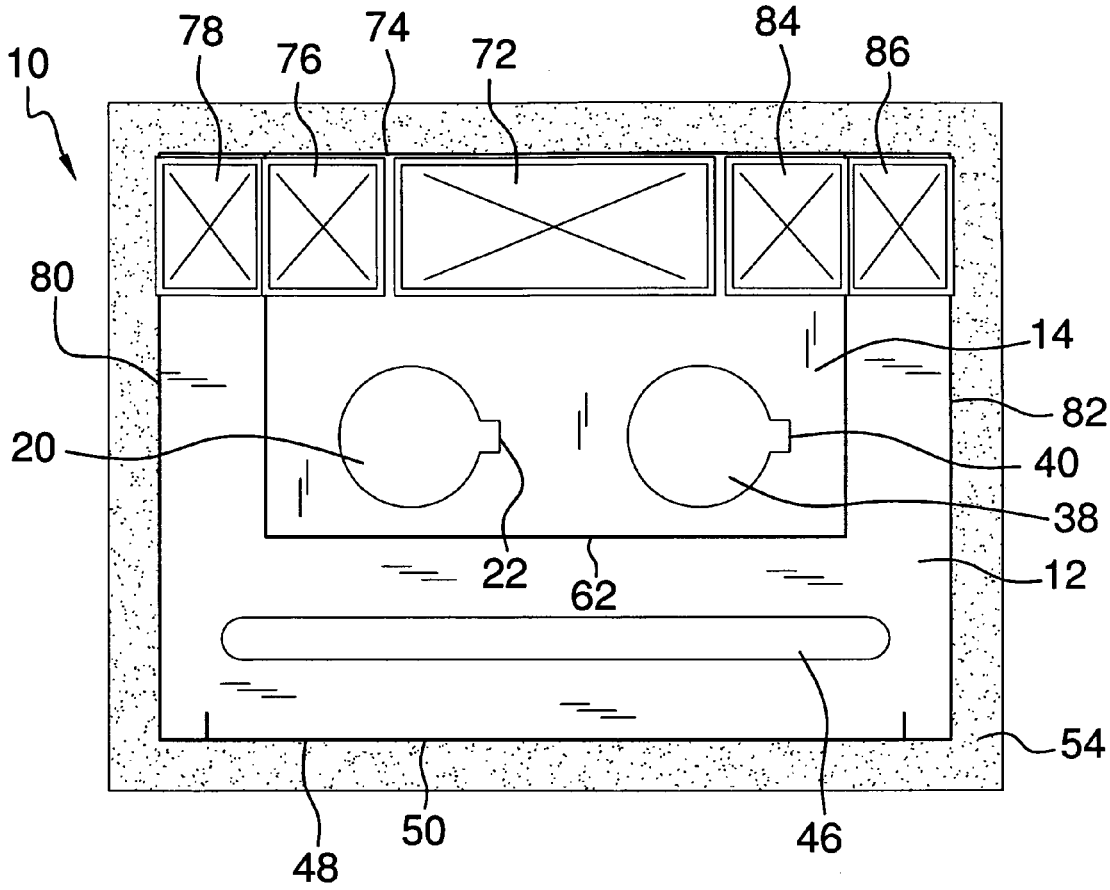
FIG. 5 is a top view of an embodiment of the disclosure.

The base tray 12 includes an elongated drain slot 46. The base tray 12 also includes an elongated angled forward edge portion 48 centrally located on a forward edge 50 of the base tray 12. Thus, the base tray 12 is designed for facilitating drainage of material such as liquid or debris over the angled forward edge portion 48. A drip towel 54 is positionable under the base tray 12 on the support surface 44. The drip towel 54 is sized larger than the dimensions of the base tray 12 to extend laterally outward from an outer perimeter 56 of the base tray 12. The upper tray 14 includes a forward edge 62 positioned in spaced relationship to the forward edge 50 of the base tray 12. The elongated drain slot 46 is positioned proximate the forward edge 50 of the base tray 12 such that the first bowl 16 is positionable over the drain slot 46 in an inverted position as shown in FIG. 4.

A plurality of storage cups 52 is positionable on the base tray 12 and the upper tray 14. The storage cups 52 are designed for holding cosmetic tools 66 such as a brush 68 and a color key 70. The storage cups 52 include an elongated storage cup 72 centrally positionable on the upper tray 14 adjacent a back edge 74 of the upper tray 14. The storage cups 52 also include a pair of upper tray cups 76,84 positionable on the upper tray 14 in alignment with the elongated storage cup 72. The storage cups 52 further include a pair of base tray storage cups 78,86 positionable on opposite sides 80,82 of the base tray 12 in alignment with the elongated storage cup 72 and the pair of upper tray storage cups 76,84.

In use, the drip towel 54 is positioned on the support surface 44, the base tray 12 and upper tray 14 are then positioned on the drip towel 54. The storage cups 52 are positioned as described above to provide an organized and easily accessed arrangement in a compact space. The first bowl 16 and second bowl 34 may be used for mixing and holding chemicals typically used by a cosmetologist. The first bowl 16 and second bowl 34 are firmly secured in the first upper tray aperture 20 and second upper tray aperture 38 to prevent accidental overturning of the first bowl 16 and second bowl 34. When done, the first bowl 16 and second bowl 34 may be cleaned and inverted on the base tray 12 over the drain slot 46 to permit drainage and ventilation into the bowls 16,34 to enhance quick drying.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A cosmetic supply organizing assembly comprising:

a base tray;

an upper tray being removably positionable on said base tray, a plurality of upper tray legs being attached to and extending downwardly from said upper tray, said upper tray legs abutting said base tray and retaining said upper tray in a spaced relationship between base tray and said upper tray and providing an access space positioned between said base tray and said upper tray;

a first bowl having a first bowl handle portion; and said upper tray having a first upper tray aperture, said first upper tray aperture having a first upper tray aperture slot portion such that said first upper tray aperture is shaped to receive said first bowl with said first bowl handle portion positioned in said first upper tray aperture slot portion, said first upper tray aperture extending through an upper surface and a lower surface of said upper tray.

2. The cosmetic supply organizing assembly of claim 1, wherein said first bowl includes a first bowl bottom portion and a first bowl lip portion, said first bowl lip portion contacting and supporting a rim of said first upper tray aperture when said first bowl is fully inserted into said first upper tray aperture such that said first bowl bottom portion is positioned in spaced relationship to said base tray.

3. The cosmetic supply organizing assembly of claim 1, further comprising:

a second bowl having a second bowl handle portion; and said upper tray having a second upper tray aperture, said second upper tray aperture having a second upper tray aperture slot portion such that said second upper tray aperture is shaped to receive said second bowl with said second bowl handle portion positioned in said second upper tray aperture slot portion.

4. The cosmetic supply organizing assembly of claim 1, further including a plurality of base tray legs coupled to said base tray.

5. The cosmetic supply organizing assembly of claim 4, wherein said base tray legs are extendable such that said base tray is adapted for being positioned a selectable distance from a support surface.

6. The cosmetic supply organizing assembly of claim 4, wherein said base tray includes an elongated drain slot.

7. The cosmetic supply organizing assembly of claim 4, wherein said base tray includes an elongated drain slot positioned proximate a forward edge of said base tray, said elongated drain slot extending through a top side and a bottom side of said base tray.

8. The cosmetic supply organizing assembly of claim 7, wherein said upper tray includes a forward edge positioned in spaced relationship to said forward edge of said base tray such that said first bowl is positionable over said drain slot in an inverted position.

9. The cosmetic supply organizing assembly of claim 1, wherein said base tray includes an angled forward edge portion such that said base tray is adapted for facilitating drainage of material over said angled forward edge portion.

10. The cosmetic supply organizing assembly of claim 1, further including a plurality of storage cups positionable on said base tray and said upper tray.

11. The cosmetic supply organizing assembly of claim 10, wherein said plurality of storage cups includes an elongated storage cup positionable on said upper tray.

12. The cosmetic supply organizing assembly of claim 11, wherein said plurality of storage cups includes a pair of upper tray cups positionable on said upper tray in alignment with said elongated storage cup.

13. The cosmetic supply organizing assembly of claim 12, wherein said plurality of storage cups includes a pair of base tray storage cups positionable on opposite sides of said base tray in alignment with said elongated storage cup and said pair of upper tray storage cups.

14. The cosmetic supply organizing assembly of claim 1, further including a drip towel positionable under said base tray.

15. A cosmetic supply organizing assembly comprising:

a base tray;

an upper tray positionable on said base tray;

a first bowl having a first bowl handle portion;

said upper tray having a first upper tray aperture, said first upper tray aperture having a first upper tray aperture slot portion such that said first upper tray aperture is shaped to receive said first bowl with said first bowl handle portion positioned in said first upper tray aperture slot portion, said first upper tray aperture extending through an upper surface and a lower surface of said upper tray;

wherein said first bowl includes a first bowl bottom portion and a first bowl lip portion, said first bowl lip portion contacting and supporting a rim of said first upper tray aperture when said first bowl is fully inserted into said first upper tray aperture such that said first bowl bottom portion is positioned in spaced relationship to said base tray;

a second bowl having a second bowl handle portion;

said upper tray having a second upper tray aperture, said second upper tray aperture having a second upper tray aperture slot portion such that said second upper tray aperture is shaped to receive said second bowl with said second bowl handle portion positioned in said second upper tray aperture slot portion;

a plurality of base tray legs coupled to said base tray;

wherein said base tray legs are extendable such that said base tray is adapted for being positioned a selectable distance from a support surface;

wherein said base tray includes an elongated drain slot, said elongated drain slot extending through a top side and a bottom side of said base tray;

wherein said base tray includes an angled forward edge portion such that said base tray is adapted for facilitating drainage of material over said angled forward edge portion;

a drip towel positionable under said base tray;

wherein said base tray includes an elongated drain slot positioned proximate a forward edge of said base tray;

wherein said upper tray includes a forward edge positioned in spaced relationship to said forward edge of said base tray such that said first bowl is positionable over said drain slot in an inverted position;

a plurality of storage cups positionable on said base tray and said upper tray, said storage cups being adapted for holding cosmetic tools;

wherein said plurality of storage cups includes an elongated storage cup positionable on said upper tray;

wherein said plurality of storage cups includes a pair of upper tray cups positionable on said upper tray in alignment with said elongated storage cup; and wherein said plurality of storage cups includes a pair of base tray storage cups positionable on opposite sides of said base tray in alignment with said elongated storage cup and said pair of upper tray storage cups.

* * * * *